US007850506B2

(12) United States Patent
Nelson et al.

(10) Patent No.: US 7,850,506 B2
(45) Date of Patent: Dec. 14, 2010

(54) BALLOON WEIGHT AND METHOD FOR PRESENTING LIGHTER-THAN-AIR BALLOONS FOR RETAIL SALE

(76) Inventors: David C. Nelson, 2727 N. Revere Rd., Akron, OH (US) 44333; Martin A. Meluch, 10668 Cable Line Rd., Newton Falls, OH (US) 44444; Valent L. Meluch, 4998 Headly Rd., Newton Falls, OH (US) 44444; Dan Bertschi, 1344 Smith Kramer St. NE., Hartville, OH (US) 44632

( * ) Notice: Subject to any disclaimer, the term of this patent is extended or adjusted under 35 U.S.C. 154(b) by 370 days.

(21) Appl. No.: 11/700,624

(22) Filed: May 10, 2007

(65) Prior Publication Data

US 2008/0057825 A1 Mar. 6, 2008

Related U.S. Application Data

(60) Provisional application No. 60/811,667, filed on Jun. 7, 2006.

(51) Int. Cl.
*A63H 3/06* (2006.01)

(52) U.S. Cl. ..... 446/220

(58) Field of Classification Search ..... 446/220, 446/223; D21/453; 248/346.01, 346.03, 248/346.06, 910; 40/212; 244/31; 242/396.6, 242/611, 600, 396.9, 396.8, 396, 297, 343.2, 242/382, 382.6, 383.3, 384.3, 385, 396.1, 242/407

See application file for complete search history.

(56) References Cited

U.S. PATENT DOCUMENTS 85,751 A * 1/1869 Morrison ..... 242/396.1
5,011,447 A * 4/1991 Watanabe ..... 446/220
5,052,085 A * 10/1991 Gau ..... 24/501
5,188,314 A * 2/1993 Peters ..... 244/31
5,514,022 A * 5/1996 Harris ..... 446/75
5,520,364 A * 5/1996 Bloxson et al. ..... 248/500
5,573,437 A * 11/1996 Van Dyke et al. ..... 446/75
5,797,783 A * 8/1998 Harris ..... 446/77
5,989,093 A * 11/1999 Nelson et al. ..... 446/220
6,076,758 A * 6/2000 Kieves et al. ..... 242/400.1
6,358,110 B1 * 3/2002 Apsner ..... 446/220
6,422,914 B1 * 7/2002 Nelson et al. ..... 446/220
6,582,272 B1 * 6/2003 Nelson et al. ..... 446/220
6,631,811 B2 * 10/2003 Komar et al. ..... 211/13.1
6,716,083 B1 * 4/2004 Castro ..... 446/220
6,745,904 B1 * 6/2004 Komar et al. ..... 211/13.1
D520,078 S * 5/2006 Pollack ..... D21/453
7,178,754 B2 * 2/2007 Anderson ..... 242/402
7,674,152 B2 * 3/2010 Anderson ..... 446/220

* cited by examiner

*Primary Examiner*—Gene Kim
*Assistant Examiner*—Scott Young
(74) *Attorney, Agent, or Firm*—Renner, Kenner, Greive, Bobak, Taylor & Weber

(57) ABSTRACT

A balloon weight includes a display clip having first and second clip members biased to be in close proximity to each other at a clip end and separate from each other each other at a squeeze end. The display clip has a base mass. A first weight piece is adapted to be selectively affixed to one of the first and second clip members. This first weight piece has a first supplemental mass. A ribbon has a first end secured to either the first weight piece or display clip and a second end affixed to a lighter-than-air balloon. A second weight piece may also be selectively affixed to the other of the first and second clip members. This permits the creation of composite balloon weights with different masses.

1 Claim, 3 Drawing Sheets

BALLOON WEIGHT AND METHOD FOR PRESENTING LIGHTER-THAN-AIR BALLOONS FOR RETAIL SALE

RELATED APPLICATIONS

This application claims the benefit of U.S. Provisional Application No. 60/811,667 filed on Jun. 7, 2006.

BACKGROUND

Display space is scarce in retail stores and must be employed efficiently. The amount of products on display should be maximized, but with due consideration given to patron traffic and aesthetics. Also, sales items should be strategically displayed in an effort to increase sales of those items. By placing like or related products in close proximity to one another, the amount of effort that must be expended by the customer in order to obtain all that he desires is decreased, and the shopping experience is typically more enjoyable. It is common for certain retail spaces to be dedicated to the needs and desires of specific target consumers. This invention focuses on displaying lighter-than-air balloons efficiently and in a manner intended to increase sales.

A number of display consideration have frustrated the successful retail sales of lighter-than-air balloons. First, they must either be sold pre-filled with helium or sold unfilled, with means for their inflation being provided on site. Pre-filled balloons float and must therefore be tied down or weighted. They also take up more display space. Unfilled balloons are difficult to sell because they do not attract the eye as do balloons floating in the air, and, therefore, it is typically not apparent to the customer that such balloons are even available for purchase. Many retail stores find it unprofitable to present a product display dedicated to the sale of balloons. Whether they are sold prefilled or filled on site after purchase, lighter-than-air balloons must be weighted down to prevent their floating away, and, thus, balloons must be sold with balloon weights secured to them. In light of these considerations, a need exists for an improved method for presenting weighted-down, lighter-than-air balloons for retail sale, and also for presenting unfilled balloons to be sold and inflated on site.

SUMMARY OF THE INVENTION

This invention provides a balloon weight that includes a display clip having first and second clip members biased to be in close proximity to each other at a clip end and separate from each other each other at a squeeze end. The display clip has a base mass. A first weight piece is adapted to be selectively affixed to one of the first and second clip members. This first weight piece has a first supplemental mass. A ribbon has a first end secured to either the first weight piece or display clip and a second end affixed to a lighter-than-air balloon. The balloon is secured to the first weight piece about a spool member so as to be capable of being wound or unwound from the spool member to extend at different lengths from the first weight piece. Additionally, the spool is lockable so that, in one position, it can rotate to permit the dispensing of a length of ribbon, and, in another position, locks so that ribbon cannot be pulled off of the spool.

This invention also provides a method for presenting lighter-than-air balloons for retail sale. A plurality of lighter-than-air balloons are provided having the same or different lift forces. A plurality of balloon weights are provided as well. Each balloon weight includes a display clip having first and second clip members biased to be in close proximity to each other at a clip end and separate from each other at a squeeze end. The display clip has a base mass. A first weight piece is adapted to be selectively affixed to one of the first and second clip members, with the first weight piece having a first supplemental mass. A ribbon has a first end secured to the first weight piece and a second end affixed to a lighter-than-air balloon in a step of affixing. The ribbon is secured to the first weight piece so as to capable of being manipulated to extend at different lengths from the first weight piece. Having provided the plurality of lighter-than-air balloons and a plurality of balloon weights, the method further includes the steps of affixing separate balloon weights to one or more of the plurality of lighter-than-air balloons. With a plurality of balloons having a plurality of balloon weights affixed thereto, the clip end of the balloon weights are attached to a display rack containing other products.

If necessary, in another embodiment of this invention, the balloon weight and method can include a second weight piece adapted to be selectively affixed to one of the first and second clip members, with the second weight piece having a second supplemental mass that may be the same or different than the first supplemental mass of the first weight piece. Thus, distinct balloon weights can be made by constructing a balloon weight to have none, one, or both of said first and second weight pieces affixed to the display clip at the first and second clip member. the configuration chosen would depend upon the lift force of the one or more lighter-than-air balloon to which the weight is to be affixed.

Through the method of this invention, product display space can be maximized. Indeed, balloons can be displayed at display racks carrying products either completely removed or related to balloons. This allows for strategic product placement. For example, in accordance with the method of this invention, lighter-than-air balloons can be presented for sale at a candy or other child-targeted section of a store, potentially increasing balloon sales by targeting the appropriate consumer. By allowing the length of ribbon to be manipulated to extend at different lengths from the balloon weight, the balloons can be kept at desired levels, rather than simply floating high in the air on long lengths of ribbon. The length of ribbon can be adjusted depending upon where the balloon weight is clipped to the display rack and where it is desired for the balloon to be floating. Filled balloons secured to weights of this invention can be clipped to a display stand that holds unfilled balloons for sale. The floating filled balloons will secure to help inform customers that such balloons are offered.

DESCRIPTION OF DRAWINGS

For a complete understanding of the objects, embodiments and structure of the present invention, reference should be made to the following detailed description and accompanying drawings wherein.

DETAILED DESCRIPTION OF PREFERRED EMBODIMENT FOR CARRYING OUT THE INVENTION

Figure 1:
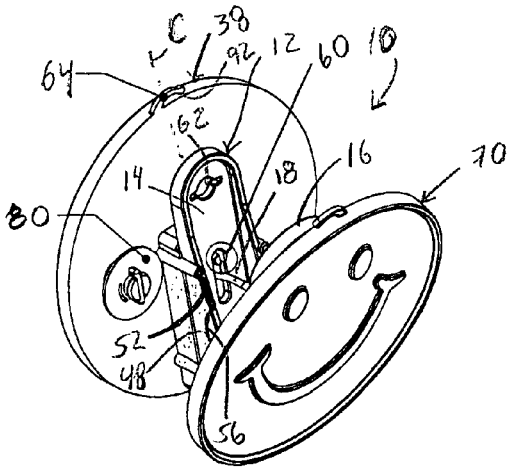
FIG. 1 is a perspective view of a balloon weight in accordance with this invention.
Figure 2:
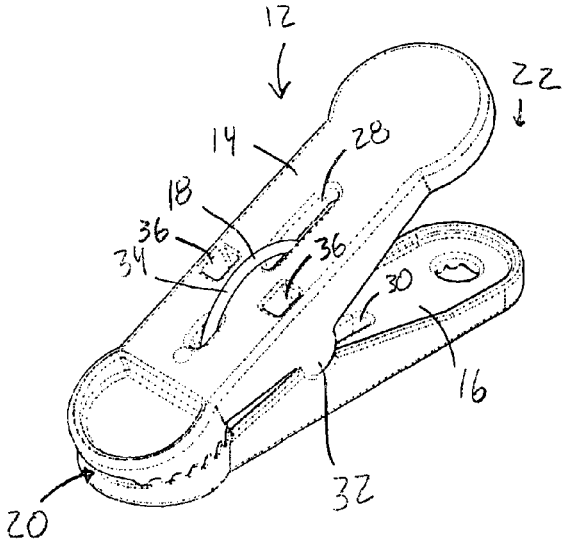
FIG. 2 is a perspective view of the display clip portion of the balloon weight.
Figure 8:
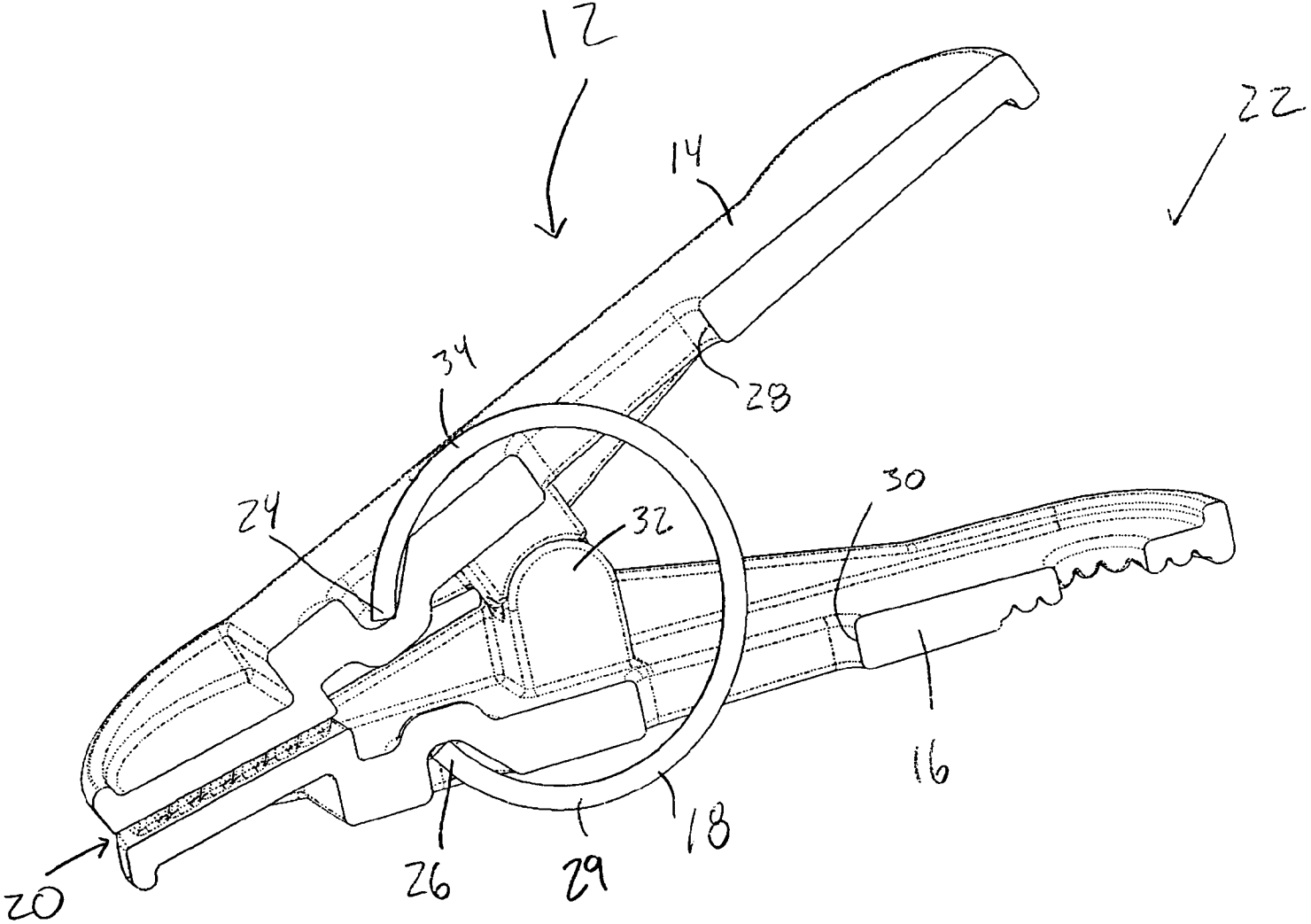
FIG. 8 is a cross sectional view of the clip member of FIG. 2.

In FIG. 1, a balloon weight 10 is shown with two smiley-face design weight pieces secured to a display clip 12, which is best seen in FIGS. 2 and 8. Display clip 12 has first clip member 14 and second clip member 16 biased by a spring 18 to be in close proximity to each other at clip end 20 and separate from each other at squeeze end 22. This arrangement permits display clip 12 to be squeezed at squeeze end 22 to place clip end 20 around a fixture and thereafter release squeeze end 22 so that clip end 20 clips onto the fixture. In the method of this invention, this fixture could be a display rack having other products (i.e., products other than filled balloons).

In the embodiment shown, spring 18 is a circular piece of metal secured at a first end 24 to first clip member 14 and secured at a second end 26 to second clip member 16. The length of the circular piece between first end 24 and second end 26 extends through first spring slot 28 in first clip member 14 and through second spring slot 30 in second clip member 16. First and second ends 24, 26 are secured on one side of hinge 32, and spring 18 extends through slots 28 and 30 on an opposite side of hinge 32. First arc portion 34 extends beyond the profile of first clip member 14 and second arc portion 29 extends beyond the profile of second clip member 16. One or more key slots 36 are provided on at least one, and preferably both, of first and second clip members 14, 16.

Figure 7:
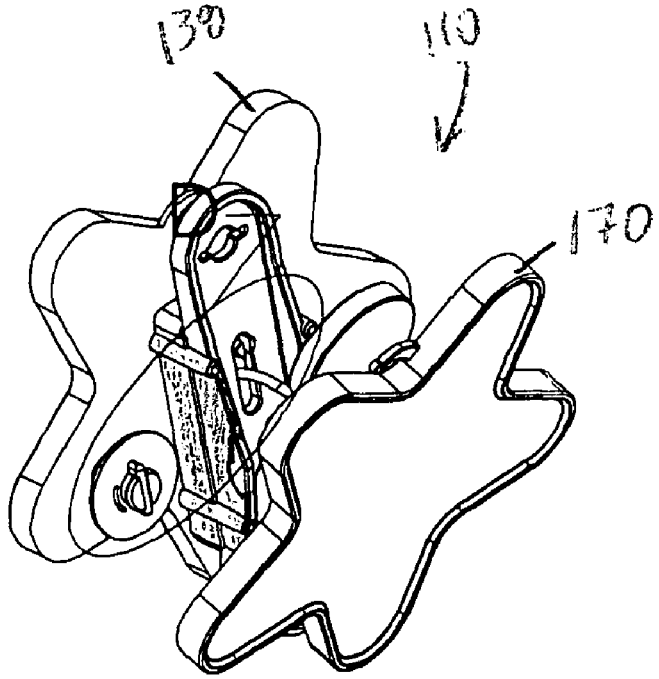
FIG. 7 is a perspective view of a balloon weight as in FIG. 1, but shown with an alternative design for the shape of the weight pieces.

The clip 12 has a base mass. This base mass might be sufficient for affixing clip 12 to a lighter-than-air balloon to prevent the balloon from floating away. However, if the lift force of the lighter-than-air balloon is great or if multiple balloons are to be secured to the clip, additional mass might be necessary. Thus, first weight piece 38 is provided to be optionally affixed to clip 12. First weight piece 38 is adapted to be selectively affixed to either the first 14 or second 16 clip member of clip 12, and has a first supplemental mass. If extra weight is needed to provide a balloon weight, first weight piece 38 can be secured to clip 12 and this combination structure can ultimately be secured to a balloon to weigh it down. First weight piece 38 also provides a decorative appearance of choice. In FIG. 1, a smiley-face is shown as weight pieces 38 and 70, and, in FIG. 7, a star is shown as weight pieces 138 and 170.

Figure 3:
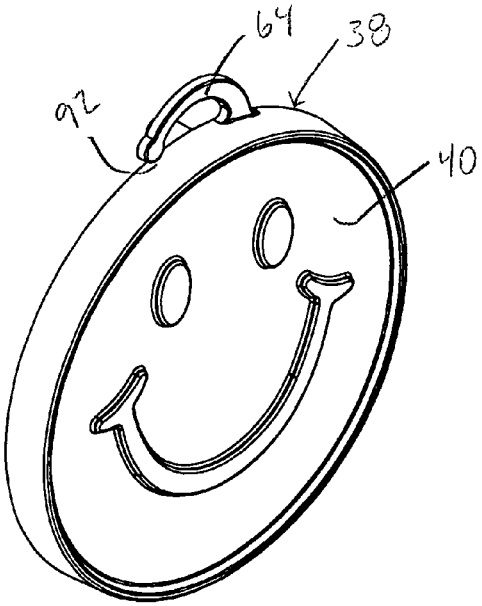
FIG. 3 is a perspective view of a front side of a weight piece that is secured to the display clip to create the balloon weight.
Figure 4:
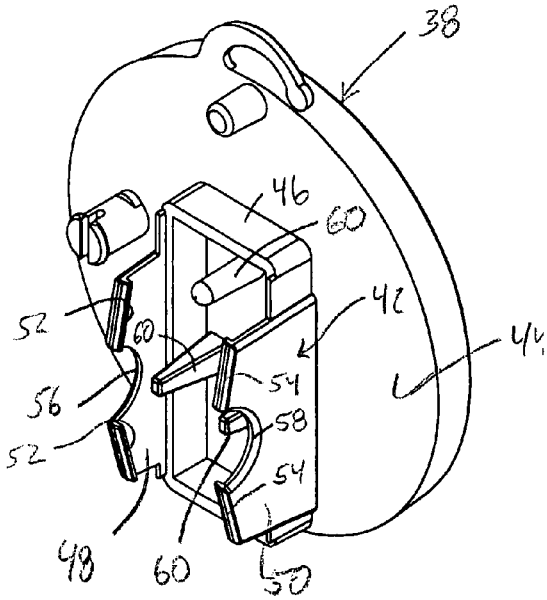
FIG. 4 is a perspective view of a back side of the weight piece of FIG. 3.

As seen in FIGS. 3 and 4, first weight piece 38 preferably provides a decorative appearance on front side 40, and provides clip fastener 42 on back side 44. Clip fastener 42 is designed to selectively engage first or second clip members 14, 16, and includes a raised box portion 46 from which extends opposed side walls 48, 50, providing opposed flanges 52, 54 extending inwardly toward each other and being discontinuous at hinge areas 56, 58. A plurality of locator keys 60 extend from back side 44 within the confines of box portion 46. As seen in FIG. 1, display clip 12 is secured to first weight piece 38 by pressing first clip member 14 past flanges 52, 54, to be gripped thereby, on either side of hinge 32. Locator keys 60 engage key slots 36 and spring slot 28 to help hold first weight piece 38 in a desired configuration. Although not shown in FIG. 1, display clip 12 can be sized such that eyelet 62 in first clip member 14 aligns with hook eyelet 64 on first weight piece 38. Such is shown for balloon weight 110 of FIG. 7. Clip end 20 of display clip 12 extends below first weight piece 38. Raised box portion 46 provides a resting surface for display clip 12 and accommodates first arc portion 34 of spring 18. A groove can be appropriately located in backside 44 to receive a portion of first arc portion 34 and thus permit the raised box portion 46 to be a bit shallower, saving material costs.

For yet additional weight, second weight piece 70 may be provided. In preferred embodiments, it is substantially identical to the first weight piece 38, although, only one of first or second weight pieces 38, 70 needs to have a ribbon spool (disclosed below). By employing both a first and second weight piece 38 and 70, a significantly heavy composite balloon weight can be provided for very large balloons or balloon displays involving multiple balloons. As seen in the figures, weights 38, 70 simply snap over display clip 12 at opposed flanges 52, 54.

Figure 5:
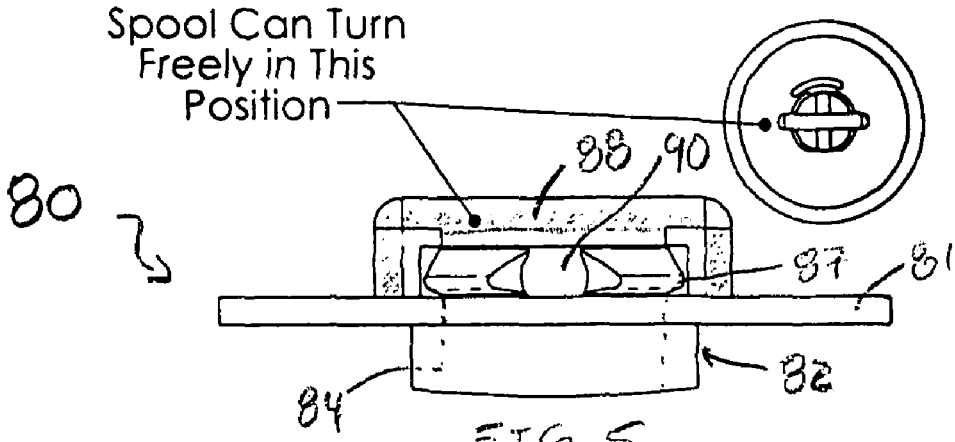
FIG. 5 is a side elevation view of the spool member secured to the weight piece, shown in the position wherein it can rotate.
Figure 6:
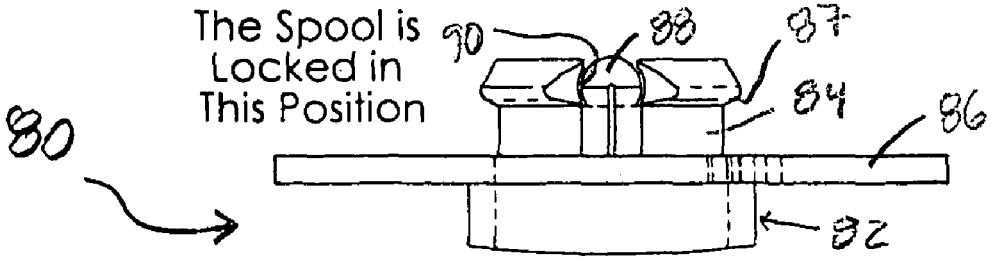
FIG. 6 is side elevation view of the spool member secured to the weight piece, shown in the position wherein it is locked and prevented from rotating.

Ribbon spool assembly 80 is provided on first weight piece 38. As seen in FIGS. 5 and 6, spool assembly 80 has an unlocked position in which it can rotate and a locked position in which it cannot. A length of ribbon (not shown) is wound about spool 82, which fits over post 84 and is held in place by spool plate 86 interacting with a lip 87 provided at the top of post 84. Lock bar 88 extends from spool plate 86, and selectively engages slot 90 in post 84, with engagement locking spool 82 against rotation and disengagement permitting the rotation of spool 82 on post 84. By moving spool plate 86 axially away from back side 44, spool 82 is able to spin and, once the desired amount of ribbon is unwound from spool 82, it can be pushed axially toward back side 44 by aligning slot 90 in post 84 with the locking bar 88 on spool 82. In this position, spool rotation is eliminated. Ribbon spool assembly 80 is placed on an opposite side of centerline C than is an opening 92 of hook eyelet 64. By orienting these elements in this way, a length of ribbon can be thread through hook eyelet 64 and a lighter-than-air balloon at the end of the ribbon would naturally pull the ribbon in a direction away from opening 92, thus preventing it from easily slipping out of hook eyelet 64, and holding it in a suitable orientation with respect to the composite balloon weight.

In an alternate embodiment for a ribbon spool, a spool member would fit onto a multi-pronged post on a weight piece of the balloon weight. Before the prongs engage apertures provided in the spool, the spool can rotate (it can also slide off of the post). Once the desired length of ribbon is unwound from the spool, it can be locked into position by inserting the multiple prongs through the multiple apertures.

Although this invention is not limited to or by any particular weight requirements, in particular embodiments, the clip member may range in weight from 10 grams to 30 grams, in other embodiments from 12 to 20 grams and in others from 15 to 18 grams. In particular embodiments, the first weight piece can be formed entirely of plastic, for example, through injection molding, and may range from 20 to 50 grams, in other embodiments from 35 to 40 grams. A second weight piece would be made to the same specifications and would be used when additional weight is mandated to counter the lift of one or more balloons secured either to the ribbon spool by a ribbon or to the eyelet on the clip member of the display clip. Because a balloon weight with a single weight piece will be easier and less expensive to manufacture and assemble, in accordance with another embodiment, a first weight piece is provided with a steel center, which is of significant mass, bringing the weigh piece to a total mass of 70 to 100 grams, in other embodiments from 75 to 96 grams, and in others from 80 to 90 grams, which will be heavy enough to counter the approximately 85 grams of lift encountered with the larger lighter-than-air balloons on the market (36 inch diameter foil, helium-filled balloon). Such a weight piece could be insert molded, i.e., plastic is molded around the steel insert.

It should be apparent that the present provides advances in the art of balloon weights. Additional aspects of the invention and the breadth thereof will be apparent from the claim language that follows.

What is claimed is:

1. A balloon weight comprising:

a weight body serving to weigh down a balloon when a balloon is secured thereto; and a spool assembly secured to said weight body including:

a post extending from said weight body to define a distal end of said post, a lip extending from said post, a slot in said distal end of said post, a spool fitted onto said post under said lip and sliding axially relative to said post between a locked position and an unlocked position, said spool engaging said lip to prevent removal of said spool from said post in an axial direction toward said lip, and a lock bar extending from said spool, said lock bar engaged with said slot in said post in said locked position such that said spool cannot rotate relative to said post and disengaged from said slot in said unlocked position such that said spool can rotate relative to said post; and a ribbon having one end secured to said spool and a free end serving to affix said ribbon to a balloon, the effective length of said ribbon relative to said balloon weight being dependent upon the length of said ribbon that is unwound from said spool, wherein the length of said ribbon unwound from said spool can be increased by pulling on said free end of said ribbon when said spool is in said unlocked position.

* * * * *